US005395448A

United States Patent [19]

Madrzak

[11] Patent Number: 5,395,448

[45] Date of Patent: Mar. 7, 1995

[54] SUPPORT BEAM OF A COATING SYSTEM

[75] Inventor: Zygmunt Madrzak, Heidenheim, Germany

[73] Assignee: J. M. Voith GmbH, Heidenheim, Germany

[21] Appl. No.: 71,454

[22] Filed: Jun. 2, 1993

[30] Foreign Application Priority Data

Jun. 4, 1992 [DE] Germany ..... 9207551 U

[51] Int. Cl.[6] ..... B05C 1/00

[52] U.S. Cl. ..... 118/231; 118/244; 118/258; 118/261; 118/413

[58] Field of Search ..... 118/205, 230, 231, 244, 118/246, 258, 261, 413

[56] References Cited

U.S. PATENT DOCUMENTS

| | | | |
|---|---|---|---|
| 1,547,257 | 7/1925 | Nasmith | 118/246 X |
| 2,681,636 | 6/1954 | Fridolph | 118/261 X |
| 3,626,833 | 12/1971 | Koch | 118/261 X |
| 3,659,553 | 5/1972 | Tobias | 118/413 X |
| 4,120,263 | 10/1978 | Boschet | 118/231 X |
| 5,005,515 | 4/1991 | Sollinger | 118/413 X |

*Primary Examiner*—David A. Simmons
*Assistant Examiner*—Paul M. Rivard
*Attorney, Agent, or Firm*—Baker & Daniels

[57] ABSTRACT

The invention concerns a support beam of a coating system for coating a web of paper or cardboard carried in or at the coating system by a roll, the support beam having a length about the same as the roll. Tie rods or thrust rods are distributed around the periphery of the support beam and are spaced at least 50 mm from the center of gravity line of the cross sectional surfaces of the beam. The cross sectional surfaces are disposed perpendicular to the longitudinal axis of the support beam. Traction or thrust devices apply a tension or compression force to at least one of the tie rods or thrust rods.

12 Claims, 3 Drawing Sheets

SUPPORT BEAM OF A COATING SYSTEM

BACKGROUND OF THE INVENTION

The invention relates to a support beam in a coating system for coating a web of paper or cardboard.

DE-OS 39 25 517 discloses a support beam for coating systems which by pressure elements arranged parallel to its longitudinal axis, in the form of pressure hoses or pressure cylinders, can be bent along its longitudinal axis in order to thereby adjust a specific course of its longitudinal axis. This also for reason of compensating for external forces which act upon the support beam.

The problem underlying the invention is to simplify the structure of a support beam which is adjustable in its flexure.

SUMMARY OF THE INVENTION

The present invention provides a support beam which is laterally adjustable along its longitudinal axis, and which has a more simplified structure than heretofore known.

The invention comprises, in one form thereof, a support beam used in a coating system for coating a web of paper or cardboard. The coating system includes a roll for carrying the web. The support beam has a length about the same as the roll and defines a longitudinal axis extending through the centroid of the support beam. The support beam includes a plurality of cross-sectional surfaces disposed generally orthogonal to the longitudinal axis, and a plurality of rods distributed around the periphery of the support beam. The rods are disposed a distance of at least 50 mm from the longitudinal axis. At least one device is provided for applying a tension or compression force to at least one of the rods.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 2:
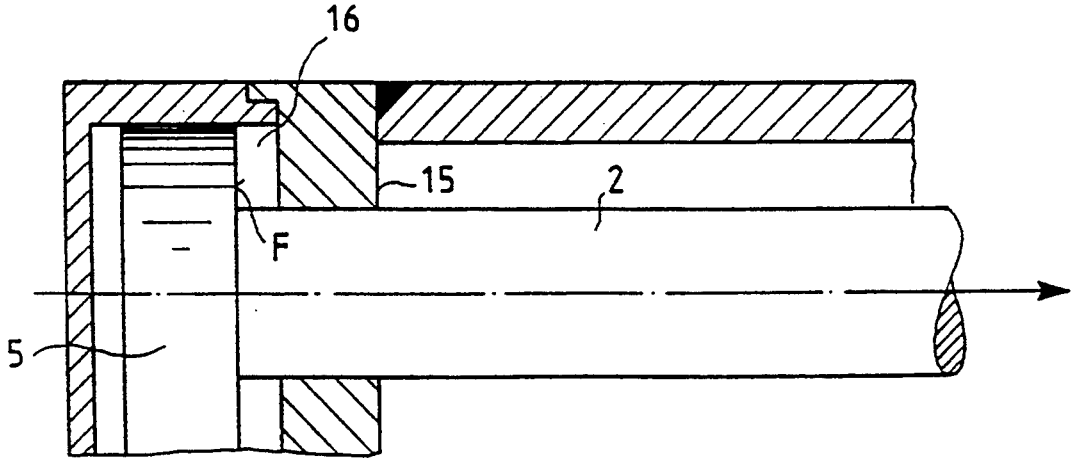
FIG. 2 is an enlarged section of FIG. 1.
Figure 3:
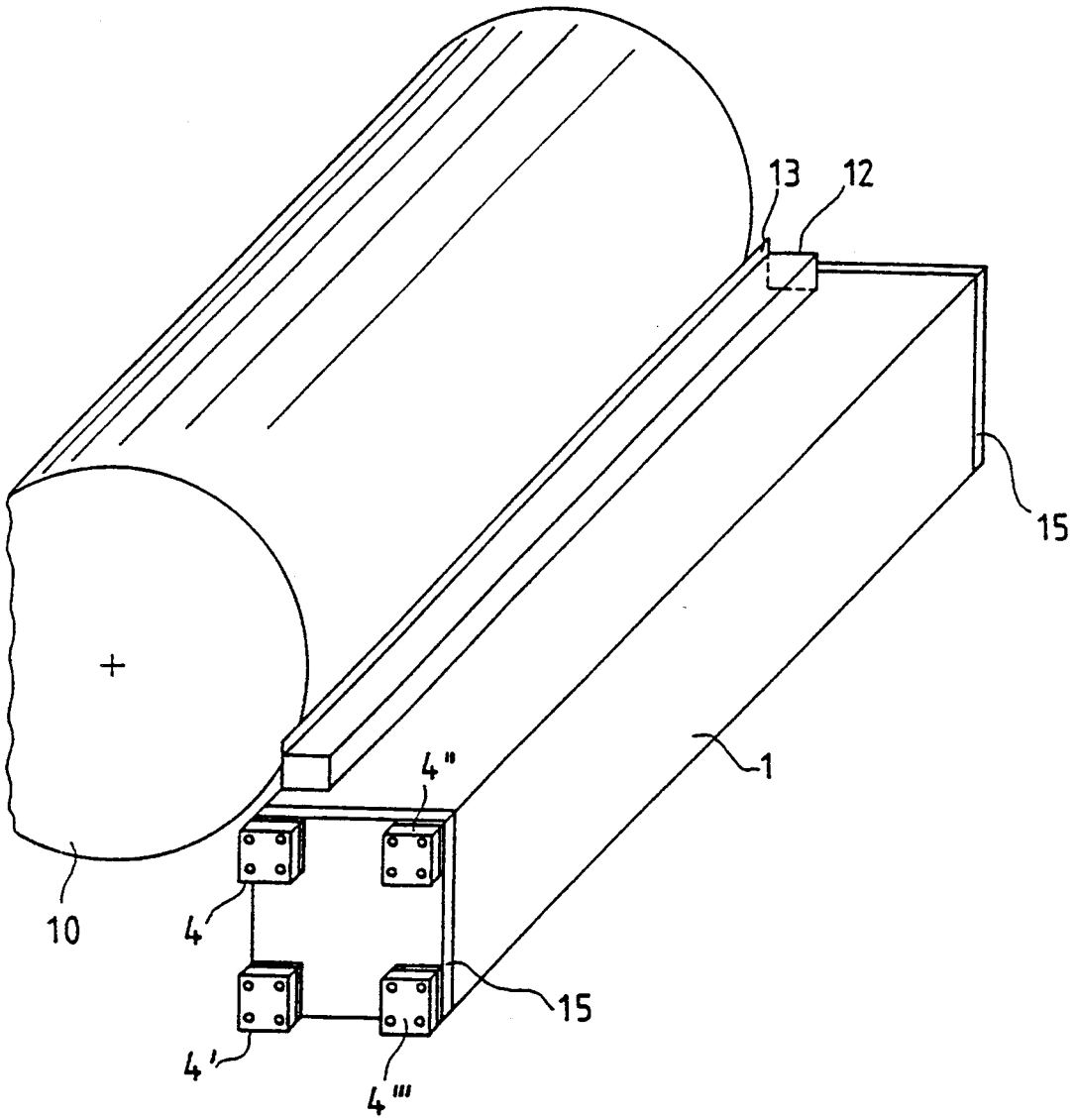
FIG. 3 is a perspective view of the support beam, doctor blade, and roll.

Generally arranged horizontally, the support beam 1 is coordinated with a roll 10 carrying, e.g., the web; it supports in this case a holding device 12 for a doctor blade 13. The latter also is known as a dosing slat. Presently, there are now tie rods 2, 2' and so forth provided which can be tightened, each, by a piston 5 (FIG. 2) of a traction unit 4, 4', 4'' and 4'''. Pressure chambers 16 are formed externally of end plates 15 of the support beam. These pressure chambers receive a preferably hydraulic pressure medium through lines not illustrated here. The pressure medium, of course, may also be compressed air. The tie rods are in this case preferably screwed into an opposite end plate 15 of the support beam so as to enable an easy exchange.

In the case of thrust rods, i.e., if the tie rods used here were used as thrust rods, it would be much more expensive to provide the respective pressure chambers for the hydraulic or pneumatic pressure medium. Furthermore, the thrust rods would then need to be secured, or supported, against deflection at points distributed uniformly across their entire length.

Figure 4:
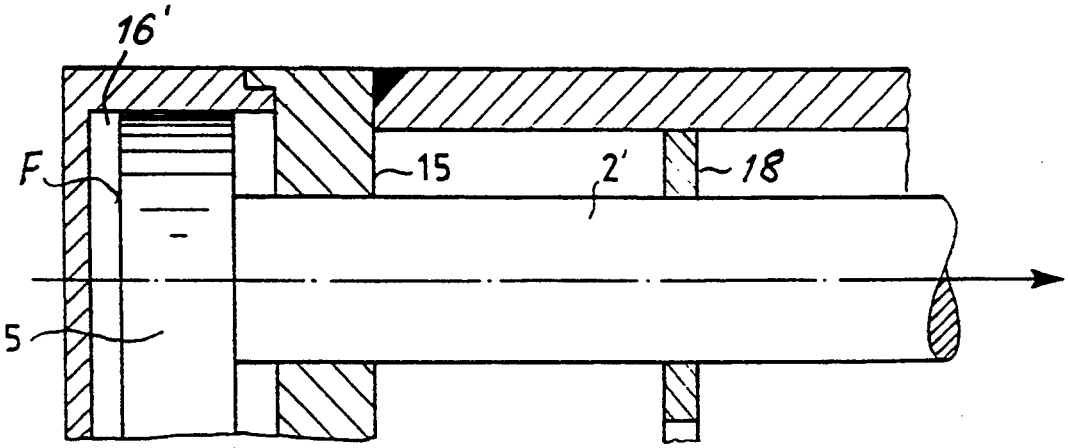
FIG. 4 is a sectional view of another embodiment of the support beam arrangement in the coating system.

This is indicated in FIG. 4 by the guide plate 18, which features guide holes fitting exactly the thrust rods 2'. A plurality of such plates 18 would be provided. The pressure chamber is referenced 16'.

Figure 1:
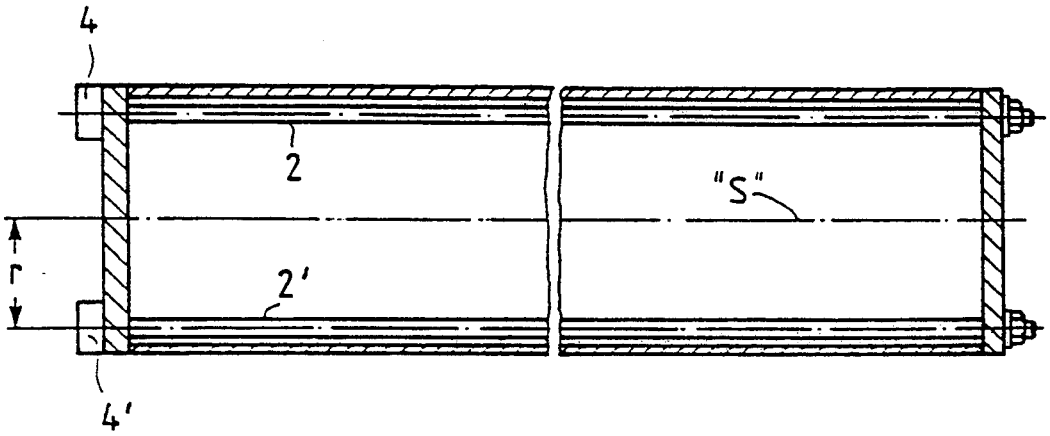
FIG. 1 is a cross section of the support beam according to an embodiment of the invention.

There exists the obvious condition, of course, that the tie rods be spaced considerably distant from the support beam axis (longitudinal axis) extending through the centroid of the support beam. According to a procedure by Maxwell-Moor, the maximum flexure of the support beam is then $f_{max}=M_b\times l^2/8EI$. (I=surface inertial moment; E=modulus of elasticity; l=beam length). The constant bending moment $M_b$ is generated by tie rods 2 and, in accordance with the spacing r from the longitudinal axis S (FIG. 1), amounts at a pressure p of the pressure chambers and with a corresponding annular face F of same to $M_b=A\times p\times r$.

Of course, tie rods 2 could be tightened by means of threaded nuts and threading (not shown).

To be able to influence the flexure in any desired direction, there are at least three tie rods (or thrust rods) required. These are then to be arranged at a preferably symmetric distribution across the cross section of the support beam-cross section perpendicular to its longitudinal axis. To a certain extent, it is also possible to deviate from the perfectly symmetric arrangement.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a coating system for coating a web of paper or cardboard and including a roll for carrying the web, a support beam having a length about the same as said roll and defining a longitudinal axis extending through the centroid of said support beam, said support beam comprising:

a plurality of cross-sectional surfaces disposed generally orthogonal to said longitudinal axis;

a plurality of rods connected to said cross sectional surfaces and distributed around the periphery of said support beam, said rods disposed a distance of at least 50 mm from said longitudinal axis; and at least one device for applying one of a tension and compression force to at least one of said rods.

2. The support beam of claim 1, wherein said support beam is hollow and wherein said rods comprise one of tie rods and thrust rods, said tie rods and thrust rods disposed within said hollow support beam.

3. The support beam of claim 2, comprising at least three of said rods.

4. The support beam of claim 1, wherein said rods are symmetrically distributed around the periphery of said support beam.

5. The support beam of claim 2, wherein said rods are symmetrically distributed around the periphery of said support beam.

6. The support beam of claim 1, wherein at least one of said rods deflects in a lateral direction upon application of said tension and compression force.

7. The support beam of claim 2, wherein at least one of said rods deflects in a lateral direction upon application of said tension and compression force.

8. In a coating system for coating a web of paper or cardboard and including a roll for carrying the web, a support beam having a length about the same as said roll and defining a longitudinal axis extending through the centroid of said support beam, said support beam comprising:

a plurality of rods connected to said support beam and disposed at a distance of at least 50 mm from said longitudinal axis; and means for applying one of a tension and compression force to at least one of said rods.

9. The support beam of claim 8, further comprising a plurality of generally planar members extending generally parallel to said longitudinal axis, said rods disposed between said longitudinal axis and said generally planar members.

10. The support beam of claim 9, wherein said generally planar members are connected to each other.

11. The support beam of claim 8, further comprising a pair of end plates, said plurality of rods extending through said end plates.

12. In a coating system for coating a web of paper or cardboard and including a roll for carrying the web, a support beam having a length about the same as said roll and defining a longitudinal axis extending through the centroid of said support beam, said support beam comprising:

a plurality of rods connected to and distributed around the periphery of said support beam, said rods disposed a distance of at least 50 mm from said longitudinal axis; and at least one device for applying one of a tension and compression force to at least one of said rods.

* * * * *